US010072589B2

(12) United States Patent
Rönnqvist et al.

(10) Patent No.: US 10,072,589 B2
(45) Date of Patent: Sep. 11, 2018

(54) METHOD FOR CHECKING THE FUNCTION OF A COMPRESSION RELEASE BRAKE SYSTEM

(71) Applicant: SCANIA CV AB, Södertälje (SE)

(72) Inventors: Patrik Rönnqvist, Norrkoping (SE); Fredrik Mörner, Nykvarn (SE)

(73) Assignee: Scania CV AB, Södertälje (SE)

( * ) Notice: Subject to any disclaimer, the term of this patent is extended or adjusted under 35 U.S.C. 154(b) by 70 days.

(21) Appl. No.: 14/978,069

(22) Filed: Dec. 22, 2015

(65) Prior Publication Data

US 2017/0175652 A1 Jun. 22, 2017

(51) Int. Cl.

| | |
|---|---|
| ***F02D 13/04*** | (2006.01) |
| ***F02D 41/22*** | (2006.01) |
| ***F01L 13/06*** | (2006.01) |
| *F02N 11/08* | (2006.01) |

(52) U.S. Cl.

CPC ..... *F02D 13/04* (2013.01); *F01L 13/065* (2013.01); *F02D 41/221* (2013.01); *F02D 2200/1002* (2013.01); *F02D 2250/24* (2013.01); *F02N 11/08* (2013.01)

(58) Field of Classification Search

CPC ..... F02D 13/04; F02D 2200/1002; F02D 41/123; F02D 41/12; F02D 41/221; F02D 41/3017; F01L 13/065; F01L 13/06

USPC ..... 701/103, 110, 112; 123/436, 481, 123/198 DB, 182.1, 90.15, 493, 320, 321, 123/325, 332, 333

See application file for complete search history.

(56) References Cited

U.S. PATENT DOCUMENTS

| | | | | |
|---|---|---|---|---|
| 5,445,128 A * | 8/1995 | Letang | B60K 31/045 | 123/436 |
| 5,479,890 A * | 1/1996 | Hu | F01L 13/06 | 123/322 |
| 6,445,982 B1 * | 9/2002 | Swales | B60K 6/485 | 307/10.6 |

(Continued)

FOREIGN PATENT DOCUMENTS

| | | |
|---|---|---|
| JP | 7-279695 A | 10/1995 |
| JP | 8-093513 A | 4/1996 |
| JP | 10-141076 A | 5/1998 |

(Continued)

*Primary Examiner* — Hai Huynh
*Assistant Examiner* — Gonzalo Laguarda
(74) *Attorney, Agent, or Firm* — Moore & Van Allen PLLC; W. Kevin Ransom

(57) ABSTRACT

Function of a compression release brake system of a compression ignited engine with a plurality of cylinders in a motor vehicle is checked by driving a crank shaft of the engine to rotate at a constant speed without injection of fuel into the cylinders while for each cylinder, for the compression release brake system in an inactive state and then in an active state, measuring the torque to be applied for maintaining said speed in a position of said crank shaft where the torque would be influenced by the behavior of that cylinder by a correctly functioning action of said compression release brake system in an active state. The torque values obtained for each cylinder for the compression release brake system in inactive and active state are compared, and the function of the compression release brake system for each individual cylinder of the engine is determined based on the comparison.

13 Claims, 3 Drawing Sheets

(56) References Cited

U.S. PATENT DOCUMENTS

2003/0115944 A1 6/2003 Martin et al.

FOREIGN PATENT DOCUMENTS

| | | | |
|---|---|---|---|
| JP | 2003-120430 | A | 4/2003 |
| JP | 2003120430 | A | 4/2003 |
| JP | 2007279695 | | 10/2007 |
| JP | 2008093573 | A | 4/2008 |
| JP | 2010141076 | A | 6/2010 |
| JP | 2011-106565 | A | 6/2011 |
| JP | 2011106565 | A | 6/2011 |
| JP | 5998518 | B2 | 9/2016 |
| WO | WO-2013/125439 | A1 | 8/2013 |

* cited by examiner

METHOD FOR CHECKING THE FUNCTION OF A COMPRESSION RELEASE BRAKE SYSTEM

FIELD OF THE INVENTION

The present invention relates to a method for checking the function of a compression release brake system of a compression ignited engine with a plurality of cylinders in a motor vehicle, said system comprising an arrangement configured, in an active state of said system, to influence opening of an exhaust valve of each said cylinder so as to obtain a braking action upon a crank shaft of the engine by influencing gas compression inside the cylinders.

BACKGROUND

The invention is not restricted to a special type of motor vehicle, although the invention is particularly applicable to heavy wheeled motor vehicles, such as trucks or lorries and buses, and the invention will for that sake hereinafter primarily be discussed for that field of use for illuminating the invention but accordingly not in any way restrict it thereto.

The fuel used in such an engine may be of any conceivable type and diesel and ethanol may be mentioned as examples. Such a compression ignited engine may offer poor possibilities to use engine braking when braking a motor vehicle. This is the reason to provide especially heavy motor vehicles with a compression release brake system for providing additional braking of the vehicle in particular when driving downhill. A compression release brake system causes braking by opening exhaust valves of the engine at positions of the operation cycle of the cylinders resulting in a modified compression in the cylinders and by that a braking action upon a crank shaft of the engine with respect to no such opening of the exhaust valves. Such exhaust valves opening may especially be carried out in connection with reaching the top dead center TDC of the piston in the cylinder after the compression cycle, so that air trapped in the cylinder is released and the piston will not receive any force from any gas pushing it down when moving away from said top dead center.

However, the function of such a compression release brake system may of course for different reasons be degraded, which may for instance be due to a malfunction related to only one or a few of the cylinders of the engine, such as an incorrectly functioning valve rocker arm for the exhaust valve of such a cylinder which may depend upon an obstruction in an hydraulic line to a chamber to be filled with hydraulic fluid for triggering modified opening of the exhaust valve or a malfunction of an hydraulic valve controlling the supply of hydraulic fluid to a said chamber. The driver of the vehicle may then bring the vehicle to a workshop and complain about the deteriorated braking effect of the compression release brake system. However, the workshop will then not have any possibility to check the function of the compression release brake system, since it is only possible to activate this system when the engine is running and the system has the required hydraulic fluid pressure making it mostly impossible to point out for which of the cylinders the valve rocker arm associated with the exhaust valve does not function correctly when activating the compression release brake system. This may then result in a replacement of said valve rocker arms for all the cylinders and a considerable unnecessary cost although perhaps only one valve rocker arm functions incorrectly when activating the compression release brake system. It is even possible that the replacement of all valve rocker arms will not result in a compression release brake system functioning perfectly would a malfunction for any of said valve rocker arms be dependent upon an obstruction of a said hydraulic fluid line.

US 2003/0115944 A1 discloses a method for checking the function of a compression release brake system, in which this system is activated and deactivated and differences in a response of the engine are compared with expected such responses. WO 2013/125439 A1 discloses another method for checking the function of a compression release brake system, in which the number of revolutions of an engine versus time is examined with the compression release brake system in an active state and in an inactive state. However, the methods disclosed in these documents have the problem just mentioned with respect to pointing out for which of the cylinders the compression release brake system does not function would it be determined that the compression release brake system as a whole has a degraded function.

SUMMARY OF THE INVENTION

The object of the present invention is to provide a method of the type defined in the introduction being improved in at least some aspect with respect to such methods already known.

This object is obtained by providing such a method with the features listed in the characterizing part of appended patent claim 1.

Accordingly, the crank shaft is in a step a) driven without injection of fuel and the torque to be applied thereto for maintaining a constant speed thereof is measured in an active and an inactive state of the compression release brake system. The torque values so obtained for each cylinder are then in a step b) compared and the function of said system for each individual cylinder is in a step c) determined based upon the result of this comparison. Thus, by the quite new approach to drive the engine without supply of fuel and carry out a so-called compression test then possible with the compression release brake system in an active and in an inactive state and comparing the results of the compression test for each cylinder in these states it will be possible to detect any malfunction of one or more cylinders with respect to the function of the compression release brake system. This is due to the fact that the compression in a cylinder is changed if the compression release brake system is activated and functions correctly with respect to that cylinder. This means that it may be avoided to replace a valve rocker arm or take any other measures for repairing the compression release brake system for a cylinder for which it in fact functions correctly. Furthermore, the method according to the invention will be easy to carry out in a short time and by that to a low cost also with respect to time consumption.

According to an embodiment of the invention in step b) for each cylinder the torque value obtained in an inactive state of the system is compared with the torque value obtained in an active state of the system, and it is determined that if the torque value in said active state exceeds the torque value in said inactive state by at least a predetermined level said compression release brake system functions correctly for that cylinder. By carrying out such a comparison of said torque values of said active and inactive states of the compression release brake system for each cylinder it may reliably be determined which cylinder or cylinders have a correct function with respect to the compression release brake system.

According to another embodiment of the invention it is determined that if for a cylinder the torque value in said active state deviates by less than a predetermined value from the torque value in said inactive state a malfunction of said compression release brake system exists for that cylinder. This malfunction may then be due to that the compression release brake system will not function at all for that cylinder, i.e. not be active for that cylinder in the active state of said system, or the compression release brake system will be active all the time for that cylinder and then also have a braking action upon the engine by that cylinder when the compression release brake system is in an inactive state.

According to another embodiment of the invention when it has been determined that a said malfunction of the compression release brake system exists for a cylinder a step of determining average values of the torque values obtained for all cylinders in said inactive state and said active state of the compression release brake system is carried out, these two average values are compared, and it is determined that a malfunction of said compression release brake system exists for all said cylinders if a difference of said two average values is less than a predetermined value. In another embodiment of the invention said torque value in said active state of said system may for each cylinder be compared with said average value for the torque values in said inactive state of the system, and it is determined that if the difference of said torque value in said inactive state for a cylinder and said average torque value in said inactive state exceeds a predetermined level the compression release brake system is permanently in an active state for that cylinder. Thus, this type of malfunction of the compression release brake system for a cylinder may be detected in this way.

According to another embodiment of the invention said torque value in said active of said system is for each cylinder compared with said average value of the torque values obtained for all cylinders in said active state of the system, and it is determined that said compression release brake system is permanently inactive for a cylinder for which said average torque value in said active state of said system exceeds said torque value for that cylinder in said active state by at least a predetermined value.

According to another embodiment of the invention the torque measurements in step a) are carried out by measuring changes of the rotation speed of a flywheel connected to said crank shaft of said engine in the respective said position of the crank shaft. Thus, "measuring the torque" has not to be a direct measuring of the torque but the torque may be calculated from measurements of changes of said rotation speed, i.e. accelerations, which will result from transferring the compression release brake system from an inactive state to an active state or conversely.

According to another embodiment of the invention a start motor of said engine is operated for driving said crank shaft in step a). It is suitable to use the start motor of the engine for carrying out the driving of the crank shaft of the engine without fuel supply to the engine for checking the function of the compression release brake system in accordance with the invention.

According to another embodiment of the invention said crank shaft of the engine is in step a) driven by driving means separate from said engine, such as another engine, an electric motor, a belt driving wheels of a driven axle of said motor vehicle etc. These are other options for driving said crank shaft to rotate for carrying out the method according to the invention.

According to another embodiment of the invention said engine is started and driven with injection of fuel into said cylinders for obtaining a constant temperature of the cylinders thereof substantially independent upon the environment before carrying out step a). Substantially steady conditions when performing the method according to the invention may by this be obtained.

According to another embodiment of the invention said active state of the compression release brake system is obtained by controlling said arrangement to open the exhaust valve of each cylinder to be open after the return of a piston in the cylinder at the top dead center after compression stroke of said piston. Thus, this means that said position for measuring the torque will for each cylinder be when the piston of that cylinder has reached said top dead center and moves away therefrom.

The invention also relates to a computer program product and electronic control unit configured to perform the operations of the invention.

Other advantageous features as well as advantages of the present invention appear from the description following below.

BRIEF DESCRIPTION OF THE DRAWINGS

With reference to the appended drawings, below follows a specific description of an embodiment of the invention cited as an example.

In the drawings.

DETAILED DESCRIPTION

The invention is not restricted to a special type of motor vehicle, although the invention is particularly applicable to heavy wheeled motor vehicles, such as trucks or lorries and buses, and the invention will for that sake hereinafter primarily be discussed for that field of use for illuminating the invention but accordingly not in any way restrict it thereto.

Figure 1:
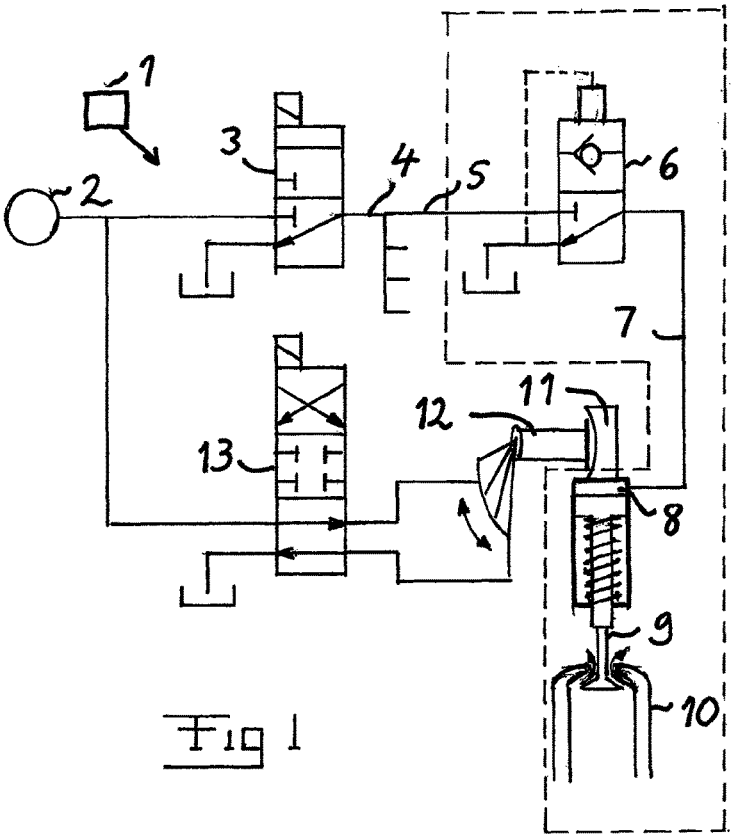
FIG. 1 is a very schematic view illustrating a compression release brake system to which a method for checking the function thereof according to the invention may be applied.

The general construction of a compression release brake system is schematically illustrated in FIG. 1. This system may be activated by an engine control unit 1 and is an hydraulic system with an hydraulic pump 2 supplying hydraulic fluid to a first solenoid valve 3 connecting to an hydraulic line 4 branched into as many lines as cylinders of the engine, and only one 5 of these lines and components associated therewith is shown in FIG. 1. This line 5 is connected to a control valve 6 connected through a line 7 to a chamber 8 in connection with a rocker arm valve 9 forming an exhaust valve of a cylinder 10 of said engine. It is illustrated how a cam 11 of a cam shaft 12 of the engine may upon rotation of the cam shaft push the rocker arm valve 9 downwardly as seen in FIG. 1 for opening said exhaust valve.

The function of the compression release brake system is as follows. When the driver of a motor vehicle provided with said engine activates the compression release brake system the engine control unit 1 controls the first solenoid valve 3 to open and supply hydraulic fluid to each said control valve 6 filling the chamber 8 with hydraulic fluid, which results in an extension of the rocker arm so that this will be hit by said cam 11 in a position in which the cam would not hit that rocker arm in absence of hydraulic fluid in the chamber 8. That will be a position when the piston belonging to the cylinder 10 is near the top dead center TDC, so that air compressed in the cylinder is released and no energy is returned to the crank shaft. Energy is instead absorbed and the torque to rotate the crank shaft will increase and the engine braked.

When the compression release brake system is not needed anymore the engine control unit 1 will control the first solenoid valve 3 to close and the control valve 6 to empty the chamber 8, so that the exhaust valve of the cylinder will not open in said position for such braking action any more.

It is shown how the compression release brake system has a second part connecting the hydraulic pump 2 to a second solenoid valve 13 also controlled by the engine control unit 1. This valve 13 may control the cam 11 by turning the entire exhaust cam shaft 12 and is accordingly a so-called cam phaser. This results in an additional influence upon braking of the engine by influencing the exhaust valve of the respective cylinder. By carrying out such cam phasing the exhaust valve may be brought to open earlier, so that it may be open during the expansion stroke and by that let an over pressure from the exhaust side into the cylinder. This earlier opening of the exhaust valve will then result in an earlier closing of the valve during the exhaust stroke, which results in an additional compression stroke in the operation cycle of the piston and the braking of the engine increases.

The present invention is directed to checking the function of a compression release brake system of this type, but it is preferably only directed to checking the function of the part of the system connected to the first solenoid valve 3 and resulting in a compression release by opening the exhaust valve and by that letting gas out thereof close to said top dead center of the piston, since a malfunction of the cam phasing part of the compression release brake system may easier be obtained by suitable sensors.

A malfunction of the compression release brake system with respect to a cylinder of the engine may be due to an obstruction of the line 7 from the control valve 6 to the chamber 8 or that the rocker arm valve 9 may not be acted upon for any other reason. The chamber 8 will then not be filled with oil for obtaining compression release and braking. A malfunction of the control valve 6 may also prevent the chamber 8 from being emptied, so that the compression release braking action will remain for that cylinder also when the engine control unit has controlled the compression release brake system to assume an inactive state.

Figure 2:
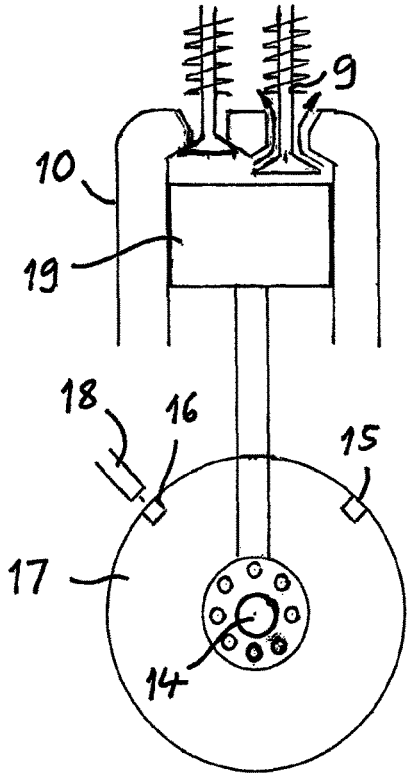
FIG. 2 is a very schematic view of parts of an engine provided with a compression release brake system according to FIG. 1 used for explaining said method according to an embodiment of the invention.

A method for checking the function of this part of the compression release brake system according to an embodiment of the invention will now be explained while at the same time making reference to FIG. 2. This engine is first of all started and driven with injection of fuel into the cylinders thereof for obtaining a constant temperature of the cylinders substantially independent upon the environment, such as by driving the engine in 10 minutes. The crank shaft 14 of the engine is then driven without injection of fuel into the cylinders by the start motor of the engine. When the number of revolutions has been stabilized so that the crank shaft rotates with a constant speed the time it takes for two subsequent marks 15, 16, such as holes, in a flywheel 17 of the engine to pass a sensor 18 when a piston 19 of a cylinder passes said top dead center is measured. This is made both with the compression release brake system in an active and in an inactive state. The time measured indicates how much the flywheel has been braked or accelerated before and after the top dead center of the piston of the cylinder. This corresponds to a torque measurement and the torques measured for that cylinder in said two different states of the compression release brake system are then compared, and if the difference of these torque values exceeds a predetermined level it may be concluded that the compression release brake system functions correctly for that cylinder. This procedure may then be repeated for each cylinder of the engine. Would for any of the cylinders the difference of said torque values be less than a predetermined value it may be concluded that the compression release brake system does not function correctly for that cylinder. The malfunction may then either be a constant braking action applied by said system or no such braking action applied even if the compression release brake system is in an active state. Comparison of the torque values measured for this cylinder with average of torque values measured for all cylinders for the compression release brake system in an active and in an inactive state will then show which type of malfunctions exists for that cylinder.

Figure 3:
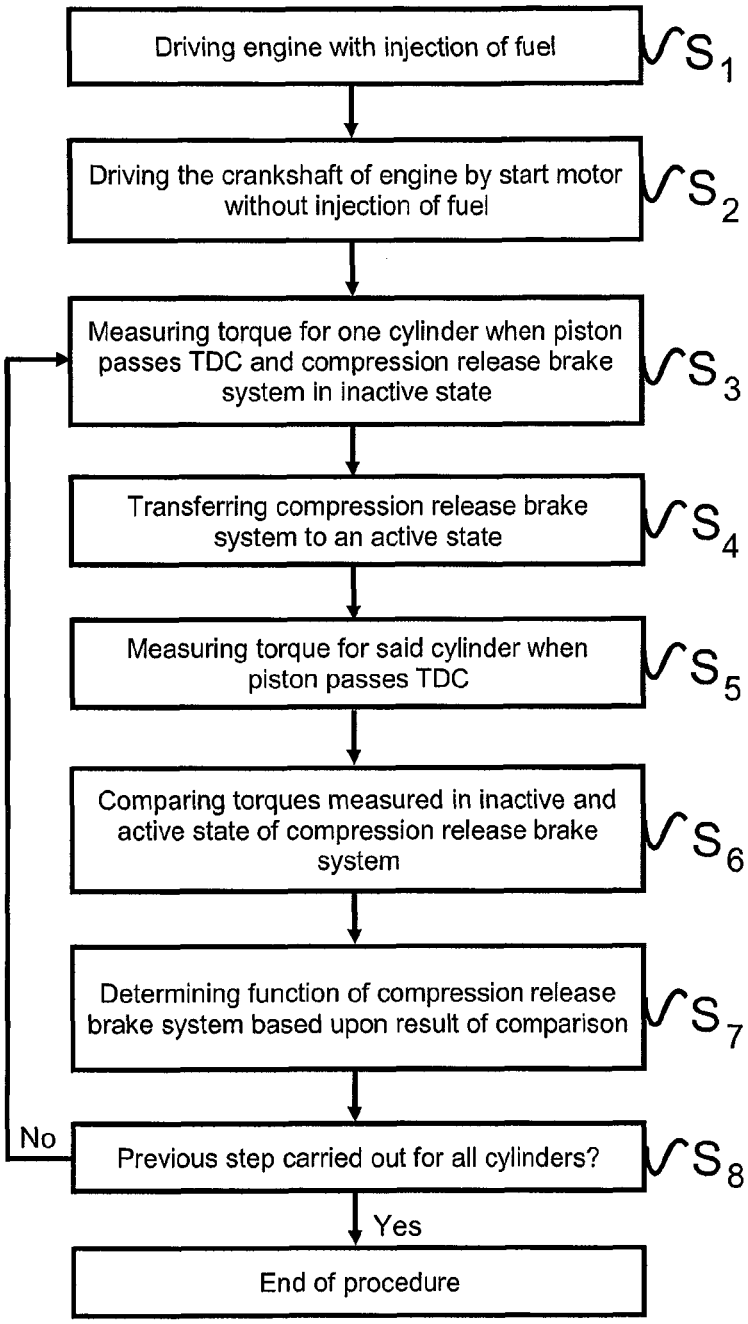
FIG. 3 is a flow chart illustrating the steps carried out in a method according to an embodiment of the invention.

FIG. 3 illustrates a flowchart of a method according to an embodiment of the present invention carried out for checking the function of a compression release brake system of a compression ignited engine with a plurality of cylinders in a motor vehicle. The method is started with a step $S_1$ of driving the engine with injection of fuel for obtaining a constant temperature of the cylinders of the engine. A start motor of the engine is then in a second step $S_2$ activated to drive a crank shaft of the engine to rotate at a constant speed without injection of fuel into the cylinders. With the compression release brake system in an inactive state the torque is measured for one of the cylinders when the piston passes the top dead center by measuring time interval between marks on a flywheel of the engine passing a sensor in a step $S_3$. The compression release brake system is then in a step $S_4$ transferred to an active state, and in a step $S_5$ the same measurements as in step $S_3$ is made. The torque values obtained for the cylinder for the compression release brake system in inactive and active state are then compared in a step $S_6$. The function of the compression release brake system is in a step $S_7$ determined for the cylinder based upon the result of this comparison. The question "Previous step carried out for all cylinders?" is then asked in a Step $S_8$. When the answer to this question is no the steps $S_3$ to $S_8$ are then repeated until this has been done for all cylinders of the engine.

Figure 4:
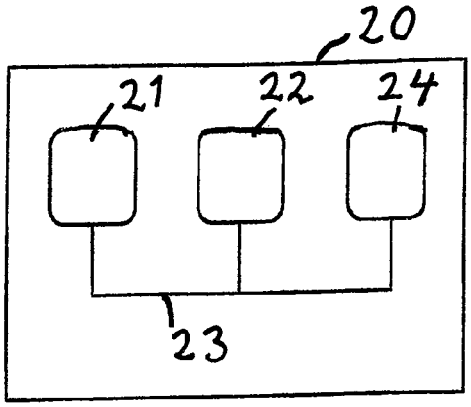
FIG. 4 is a schematic view illustrating an electronic unit for implementing a method according to the invention.

Computer program code for implementing a method according to the invention is with advantage included in a computer program which can be read into the internal memory of a computer, e.g. the internal memory of an electronic control unit of a motor vehicle. Such a computer program is with advantage provided via a computer program product comprising a data storage medium which can be read by a computer and which has the computer program stored on it. Said data storage medium is for example an optical data storage medium in the form of a CD ROM disc, a DVD disc etc., a magnetic data storage medium in the form of a hard disc, a diskette, a cassette tape etc., or a flash memory or a memory of the ROM, PROM, EPROM or EEPROM type. FIG. 4 illustrates very schematically an electronic control unit 20 comprising an execution means 21, e.g. a central processor unit (CPU), for execution of computer software. The execution means 21 communicates with a memory 22, e.g. of the RAM type, via a data bus 23. The control unit 20 comprises also a non-transitory data storage medium 24, e.g. in the form of a flash memory or a memory of the ROM, PROM, EPROM or EEPROM type. The execution means 21 communicates with the data storage medium 24 via the data bus 23. A computer program comprising computer program code for implementing a method according to the invention, e.g. in accordance with the embodiment illustrated in FIG. 3, is stored on the data storage medium 24.

The invention is of course in no way restricted to the embodiment described above, since many possibilities to modifications thereof are likely to be obvious to one skilled in the art without having to deviate from the scope of invention defined in the appended claims.

The torque measurements may be carried out in other ways than described above. If for example an electric motor is used to drive the crank shaft of the engine when carrying out the method according to the invention the current to that motor may be measured as a measure of the torque instead of the acceleration of the flywheel.

The invention claimed is:

1. A method for checking the function of a compression release brake system of a compression ignited engine with a plurality of cylinders in a motor vehicle, said system comprising an arrangement configured, in an active state of said system, to influence opening of an exhaust valve of each said cylinder so as to obtain a braking action upon a crank shaft of the engine by influencing gas compression inside the cylinders and in an inactive state to maintain the exhaust valve of each said cylinder in a closed position to maintain compression inside the cylinders, said method comprising the steps:

a) driving said crank shaft to rotate at a constant revolutions per minute (RPM) without injection of fuel into said cylinders and for each cylinder, for the compression release brake system in an active state and then in an inactive state or in opposite order, measuring the torque to be applied for maintaining said constant RPM in a position of said crank shaft where the torque would be influenced by the behavior of that cylinder by a correctly functioning action of said compression release brake system in an active state thereof;

b) comparing the torque values obtained for each cylinder in step a) for said compression release brake system in said inactive state and said active state, respectively;

c) determining the function of said compression release brake system for each individual cylinder of the engine based upon the result of said comparison; and d) providing an indication of the determined functional status of the compression release brake system electronically to a user.

2. A method according to claim 1, wherein in step b) for each cylinder said torque value obtained in an inactive state of said system is compared with the torque value obtained in an active state of said system, and that it is determined that if the torque value in said active state exceeds the torque value in said inactive state by at least a predetermined level said compression release brake system functions correctly for that cylinder.

3. A method according to claim 2, wherein it is determined that, if for a cylinder the torque value in said active state deviates by less than a predetermined value from the torque value in said inactive state, a malfunction of said compression release brake system exists for that cylinder.

4. A method according to claim 3, wherein that when it has been determined that a said malfunction of the compression release brake system exists for a cylinder, a step of determining average values of the torque values obtained for all cylinders in said inactive state and said active state of the compression release brake system is carried out, that these two average values are compared, and that it is determined that a malfunction of said compression release brake system exists for all said cylinders, if a difference of said two average values is less than a predetermined value.

5. A method according to claim 4, wherein that, for each cylinder, said torque value in said inactive state of said system is compared with said average value of the torque values in said inactive state of the system, and that it is determined that if the difference of said torque value in said inactive state for a cylinder and said average torque value in said inactive state exceeds a predetermined level, the compression release brake system is permanently in an active state for that cylinder.

6. A method according to claim 4, wherein that, for each cylinder, said torque value in said active state of said system is compared with said average value of the torque values obtained for all cylinders in said active state of the system, and that it is determined that said compression release brake system is permanently inactive for a cylinder for which said average torque value in said active state of said system exceeds said torque value for that cylinder in said active state by at least a predetermined value.

7. A method according to claim 1, wherein the torque measurements in step a) are carried out by measuring changes of a rotation speed of a flywheel connected to said crank shaft of said engine in the respective said position of the crank shaft.

8. A method according to claim 1, wherein a start motor of said engine is operated for driving said crank shaft in step a).

9. A method according to claim 1, wherein said crank shaft of the engine is in step a) driven by driving means separate from said engine.

10. A method according to claim 1, wherein said engine is started and driven with injection of fuel into said cylinders for obtaining a constant temperature of the cylinders thereof substantially independent upon the environment before carrying out step a).

11. A method according to claim 1, wherein said active state of the compression release brake system is obtained by controlling said arrangement to open the exhaust valve of each cylinder after the return of a piston in the cylinder at the top dead center after a compression stroke of said piston.

12. A computer program product comprising computer program code located on a non-transitory medium which is readable by one or more computing devices, wherein the computer program code is used for checking the function of a compression release brake system of a compression ignited engine with a plurality of cylinders in a motor vehicle, said system comprising an arrangement configured, in an active state of said system, to influence opening of an exhaust valve of each said cylinder so as to obtain a braking action upon a crank shaft of the engine by influencing gas compression inside the cylinders and in an inactive state to maintain the exhaust valve of each said cylinder in a closed position to maintain compression inside the cylinders, wherein the computer program product comprises instructions for operation by one or more computing devices to cause said one or more computing devices to:

a) drive said crank shaft to rotate at a constant revolutions per minute (RPM) without injection of fuel into said cylinders and for each cylinder, for the compression release brake system in an active state and then in an inactive state or in opposite order, measuring the torque to be applied for maintaining said constant RPM in a position of said crank shaft where the torque would be influenced by the behavior of that cylinder by a correctly functioning action of said compression release brake system in an active state thereof;

b) compare the torque values obtained for each cylinder in step a) for said compression release brake system in said inactive state and said active state, respectively; and c) determine the function of said compression release brake system for each individual cylinder of the engine based upon the result of said comparison; and d) provide an indication of the determined functional status of the compression release brake system electronically to a user.

13. An electronic control unit comprising:

one or more computing devices;

a memory connected to the one or more computing devices; and a data storage medium connected to the one or more computing devices, said data storage medium being non-transitory and comprising a computer program product comprising computer program code which is readable by one or more computing devices, wherein the computer program code is used for checking the function of a compression release brake system of a compression ignited engine with a plurality of cylinders in a motor vehicle, said system comprising an arrangement configured, in an active state of said system, to influence opening of an exhaust valve of each said cylinder so as to obtain a braking action upon a crank shaft of the engine by influencing gas compression inside the cylinders and in an inactive state to maintain the exhaust valve of each said cylinder in a closed position to maintain compression inside the cylinders, wherein the computer program product comprises instructions for operation by one or more computing devices to cause said one or more computing devices to:

a) drive said crank shaft to rotate at a constant revolutions per minute (RPM) without injection of fuel into said cylinders and for each cylinder, for the compression release brake system in an active state and then in an inactive state or in opposite order, measuring the torque to be applied for maintaining said constant RPM in a position of said crank shaft where the torque would be influenced by the behavior of that cylinder by a correctly functioning action of said compression release brake system in an active state thereof;

b) compare the torque values obtained for each cylinder in step a) for said compression release brake system in said inactive state and said active state, respectively; and c) determine the function of said compression release brake system for each individual cylinder of the engine based upon the result of said comparison; and d) provide an indication of the determined functional status of the compression release brake system electronically to a user.

* * * * *